US006428136B2

(12) United States Patent
Takahashi

(10) Patent No.: US 6,428,136 B2
(45) Date of Patent: Aug. 6, 2002

(54) INK JET RECORDING METHOD AND INK JET RECORDER

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/811,503

(22) Filed: Mar. 20, 2001

(30) Foreign Application Priority Data

Mar. 31, 2000 (JP) ..... 2000-097537

(51) Int. Cl.[7] ..... B41J 29/38
(52) U.S. Cl. ..... 347/14; 347/10
(58) Field of Search ..... 347/14, 19, 10, 347/11, 17

(56) References Cited

U.S. PATENT DOCUMENTS 5,581,281 A * 12/1996 Fuse ..... 347/14
5,673,071 A * 9/1997 Fuse ..... 347/35

* cited by examiner

*Primary Examiner*—Thinh Nguyen
(74) *Attorney, Agent, or Firm*—Oliff & Berridge, PLC

(57) ABSTRACT

A recording method using an ink jet recorder with an actuator includes detecting an ink temperature and controlling a drive voltage for driving actuator depending on both of detected temperature and selected record resolution. A rate of change in the drive voltage with respect to the temperature is controlled to be smaller for higher record resolution. A constant record density is achieved regardless of selected record resolution and ink temperature.

19 Claims, 5 Drawing Sheets

INK JET RECORDING METHOD AND INK JET RECORDER

BACKGROUND OF THE INVENTION

1. Field of the Invention

The present invention relates to an ink jet recording method and an ink jet recorder. In particular, the invention relates to the ink jet recording method and an ink jet recorder for recording at a substantially constant density regardless of record resolution and temperature.

2. Description of the Related Art

Today, conventional impact recorders are being replaced by non-impact recorders, for which the market is greatly growing. Of all non-impact recorders, ink jet recorders have the simplest principle. In addition, ink jet recorders provide easy multiple gradation and easy color recording. Among others, drop-on-demand type ink jet recorders, which eject only ink droplets for recording, have been rapidly widespread because of their high ejection efficiency and low running cost.

The viscosity of ink decreases as temperature rises. Accordingly, if the record head of an ink jet recorder of this type was driven at a constant voltage for any temperature, the droplet ejection speed and droplet volume would increase at a higher temperature, increasing the record density. Therefore, common ink jet recorders of this type are each fitted with a temperature sensor for detecting the temperature of the ink in the record head or the temperature around the head. As shown in FIG. 5 of the accompanying drawings, the drive voltage is lowered as the temperature rises. This controls the record density in such a manner that it does not vary with the temperature.

In recent years, in order to print image data such as photograph with higher reproducibility, it has been demanded that the volume of ink droplets be smaller and the record resolution be higher. Accordingly, the resolution has commonly been selected depending on the purpose. Specifically, low resolution (for example, 300×300 dpi) has been selected for high-speed recording, while high resolution (for example, 600×600 dpi) has been selected for high-quality recording.

The required volume of ink droplets depends on the resolution. For example, about 60 pl (picoliters) and about 15 pl are needed for 300×300 dpi and 600×600 dpi, respectively. The droplet volume is controlled by changing the drive waveform and/or drive voltage.

For conventional ink ejectors of this type, the drive voltage curve shown in FIG. 5, which represents the relationship between temperature and drive voltage, was used for any resolution. However, many recording tests have revealed that, if there is difference in record resolution among different cases, where the ejected ink droplets differ in volume, the relationships between temperature and record density are not completely the same. Specifically, the tests have revealed that, if the ink droplets are smaller, the density change with temperature is slighter. FIG. 6 shows two conventional cases where ink droplets different in volume were ejected for different resolutions. In FIG. 6, the solid thick line represents the case where the larger droplets for the lower resolution were ejected along a drive voltage curve for constant density at any temperature. In FIG. 6, the dotted line represents the case where the smaller droplets for the higher resolution were ejected along the same voltage curve. It has been revealed as shown in FIG. 6 that, in the latter case, the density is higher at lower temperatures and it is lower at higher temperatures. There may therefore be a case where the density does not change with temperature for low-resolution recording, but it does for high-resolution recording.

SUMMARY OF THE INVENTION

It is the object of the present invention to provide an ink jet recording method and an ink jet recorder for recording at a constant record density for any record resolution and any temperature.

In accordance with a first aspect of the present invention, an ink jet recording method is provided for recording on a record medium by means of a recorder including an actuator, which has an ink channel filled with ink and a nozzle communicating with the channel. A drive voltage can be applied to the actuator so that the ink channel changes in volume to eject ink therefrom through the nozzle. This recording method comprises the steps of:

detecting the temperature of the ink or the ambient temperature around the ink;

controlling the drive voltage depending on the detected temperature and record resolution; and driving the actuator at the controlled voltage to eject ink from the ink channel through the nozzle.

The drive voltage may be lowered as the detected temperature rises. A rate of change in the drive voltage with respect to the temperature may change. The rate of change may be smaller for higher record resolution. This makes the record density roughly constant for any record resolution at any temperature, making it possible to do recording with constant quality.

The rate of change in drive voltage respect to with temperature may be determined for substantially constant record density within a predetermined temperature range, which may range between 5° C. and 45° C.

The recording method may include the step of selecting a pulse waveform for application to the actuator depending on the record resolution. This makes it possible to eject the volume of ink necessary for the record resolution. The amplitude of the pulse waveform may be lowered as the detected temperature rises.

For higher record resolution, fewer ink droplets may be ejected to form a dot on the record medium.

In accordance with a second aspect of the present invention, an ink jet recorder is provided. The recorder includes an actuator having an ink channel which can be filled with ink and a nozzle communicating with the channel. The ink channel can change in volume to eject ink from it through the nozzle when a drive voltage is applied to the actuator. The recorder also includes a switch for selecting a record resolution. The recorder also includes a temperature detector for detecting the temperature of the ink or the ambient temperature around the ink. The recorder also includes a controller for controlling the drive voltage depending on the selected resolution and the detected temperature. The controller may lower the drive voltage as the detected temperature rises. A rate of change in the drive voltage may change with respect to the ink temperature or the ambient temperature. The controller may reduce the rate of change as the selected resolution rises. The controller may make an absolute value of the rate of change in the drive voltage 0.8 or less if the selected resolution is four times (×4) or higher per unit area with respect to a standard resolution, for example, the resolution is increased from 300 dpi×300 dpi to 600 dpi ×600 dpi. This makes the record density roughly constant at any temperature, making it possible to do recording with constant quality.

The controller may determine the absolute value of the rate of change so that the record density is substantially constant within a predetermined temperature range. The predetermined temperature may range between 5° C. and 45° C.

The controller may select a pulse waveform for application to the actuator depending on the selected resolution. The controller may lower the amplitude of the pulse waveform as the detected temperature rises. For higher record resolution, fewer ink droplets may be ejected from the nozzle to form a dot on a record medium. The recorder may further include a driver for driving the actuator. The controller may send a control signal to the driver. The record resolution may be selected from at least 300×300 dpi and 600 ×600 dpi.

BRIEF DESCRIPTION OF THE DRAWINGS

A preferred embodiment of the present invention will be described with reference to the accompanying drawings, in which.

DETAILED DESCRIPTION OF THE PREFERRED EMBODIMENT

Figure 1:
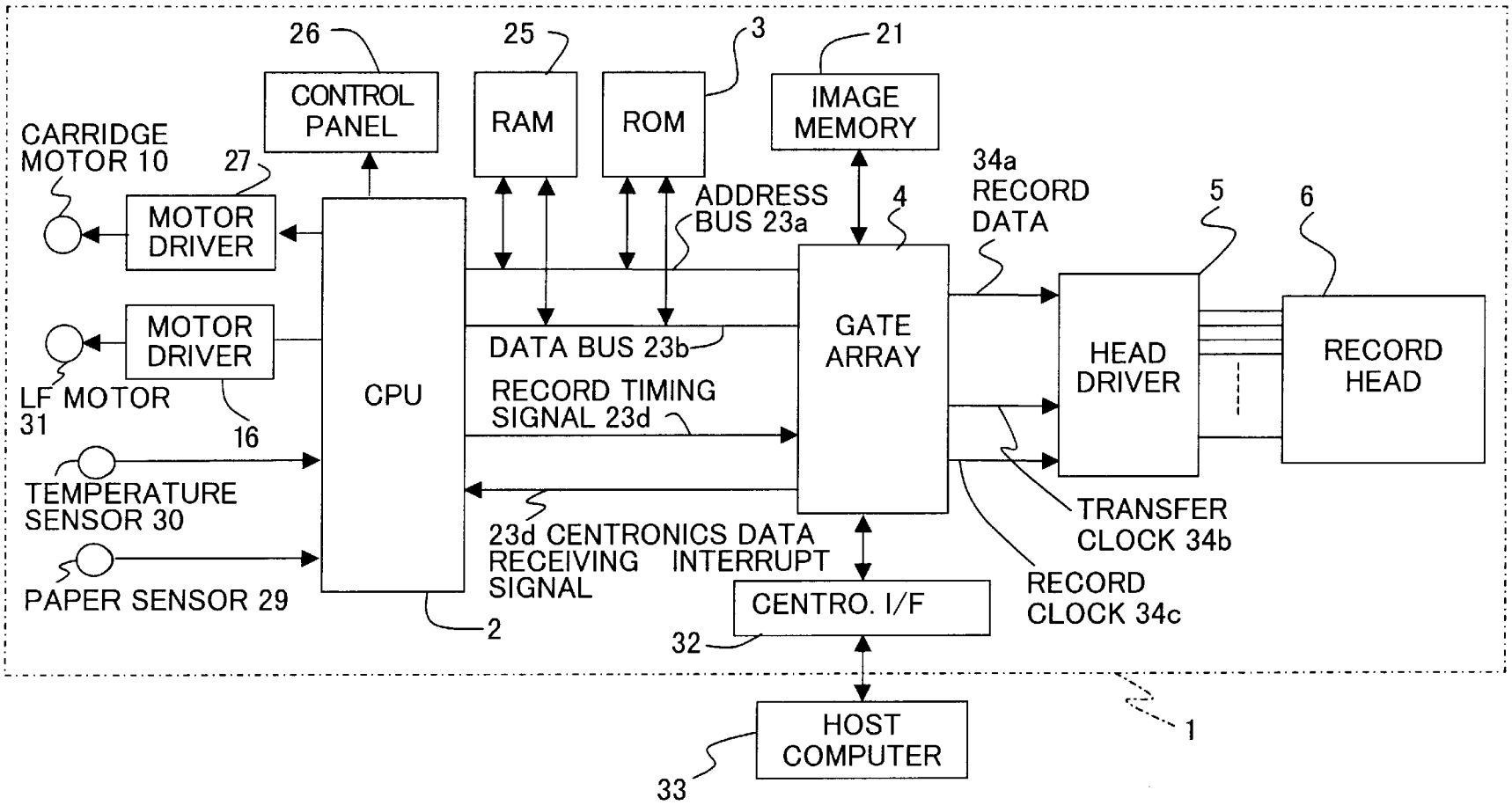
FIG. 1 is a block diagram showing the control system of a recorder which includes an ink ejector and an apparatus for driving the ejector.

With reference to FIG. 1, a recorder 1 includes a CPU 2 and a ROM 3. The CPU 2 controls the operation of the recorder 1 and is connected to the ROM 3. Stored in the ROM 3 are data related to predetermined drive pulse waveforms, which will be mentioned later on. The CPU 2 and ROM 3 are connected through a gate array circuit 4 to a head driver 5, which is connected to an ink ejector 6 in the form of an ink jet record head. The CPU 2 constitutes a controller of the invention. Based on a program stored in the ROM 3, the CPU 2 selectively reads out one of the drive pulse waveforms stored in the ROM 3. Based on detected temperature, which will be mentioned later on, the CPU 2 changes drive voltage. Depending on record resolution, the CPU 2 changes a rate of change in drive voltage with respect to temperature.

The gate array circuit 4 is connected to an image memory 21,where record data can be stored temporarily. The gate array circuit 4 allows data access to the image memory 21. The CPU 2 is connected to not only the gate array circuit 4 and ROM 3 but also a RAM 25, where various programs can be stored temporarily, a control panel 26 fitted with a switch or the like for selecting record density or concentration, a motor driver 27 for driving a carriage motor 10, a motor driver 28 for driving a line feed motor 31, a paper sensor 29 for detecting a record medium, and a temperature sensor (temperature detecting means) 30 for detecting the temperature around the record head 6. The CPU 2 exchanges necessary data with these components.

The gate array circuit 4 is connected through a Centronics interface 32 to a host computer 33. The interface 32 sends 8-bit record data by the Centronics standard to the gate array circuit 4, which writes the record data in the image memory 21. The gate array circuit 4 and CPU 2 are connected together by an address bus 23*a* and a data bus 23*b*. The gate array circuit 4 receives a record timing signal 23*d* from the CPU 2 and outputs record data 34*a*, which is serial data read from the image memory 21, to the head driver 5. The gate array circuit 4 also outputs, to the head driver 5, a transfer clock 34*b* with which the transfer of record data is timed and a record clock 34*c* with which the recording done by the record head 6 is timed. The gate array circuit 4 supplies the CPU 2 with an interrupt signal 23*c*. The record timing signal 23*d* informs the gate array circuit 4 that the carriage on which the record head 6 is mounted has entered a constant speed range and reached the record start point. The interrupt signal 23*c* is related to DMA (direct memory access), data thinning or another process done by the gate array circuit 4.

The record head (ink ejector) 6 ejects ink by changing the volume of ink channels to make pressure waves in them, as explained below. The record head 6 may be adapted to eject ink due to the pressure of the ink evaporated by a heating device.

Figure 7:
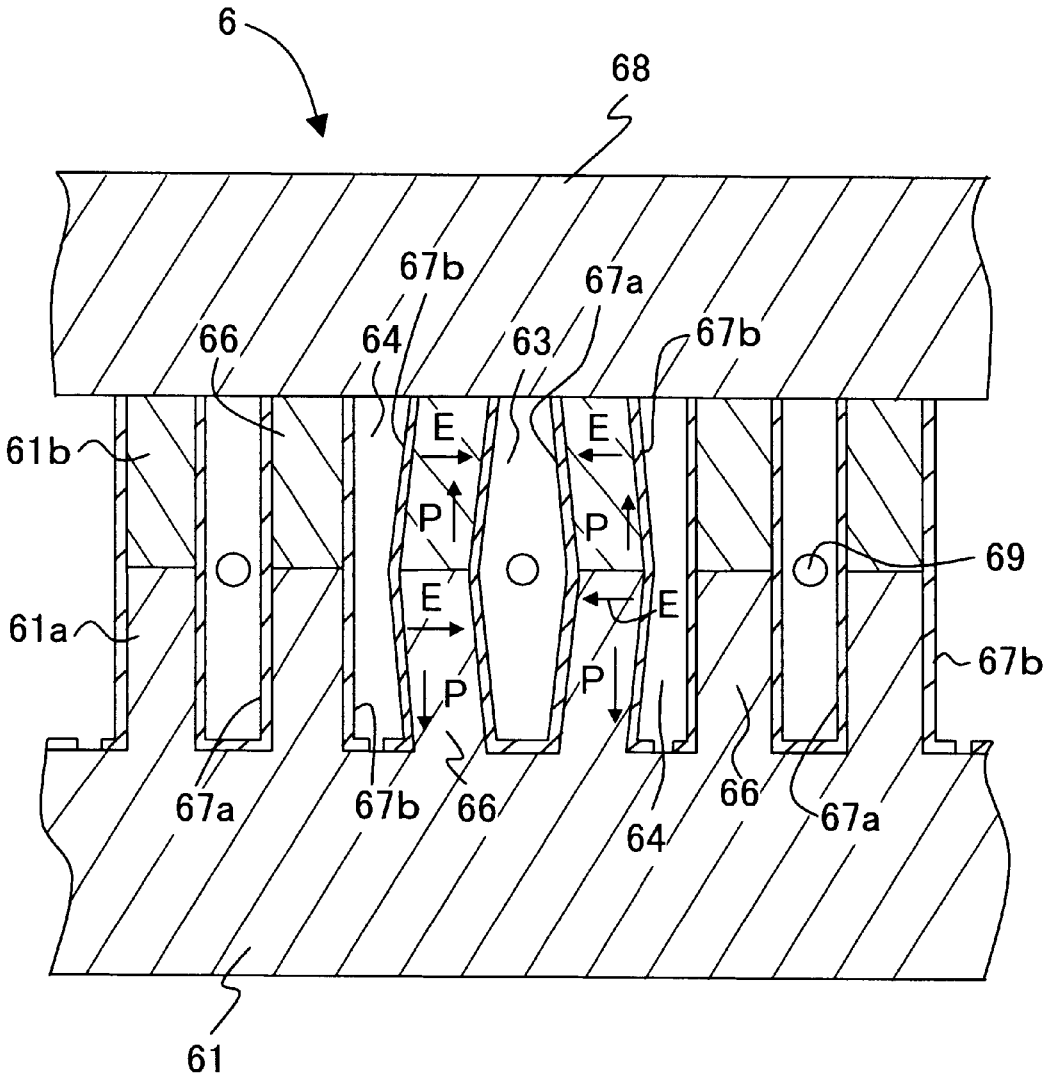
FIG. 7 is a cross section showing an ink ejector according to the prior art and the invention.

With reference to FIG. 7, the ink ejector 6 includes an actuator substrate 61 and a cover plate 68. The actuator substrate 61 has ink channels 63 and spaces (blank channels) 64 all in the form of grooves, which extend perpendicularly to a record medium set on the recorder 1. The ink channels 63 and spaces 64 are arrayed alternately, with side walls 66 interposed between them, which are made of piezo-electric material. Each side wall 66 consists of a lower wall 61*a* and an upper wall 61*b*, which are polarized in opposite directions P. Each ink channel 63 has a nozzle 69 formed at one end. The other ends of the ink channels 63 are connected to a manifold (not shown), through which ink can be supplied. Those ends of the spaces 64 which are adjacent to the manifold are closed so that no ink can enter the spaces. Both sides of each side wall 66 are fitted with a pair of electrodes 67*a* and 67*b* in the form of metallized layers. Specifically, the electrodes 67*a* and 67*b* are a channel electrode 67*a* and a space electrode 67*b*, which are positioned in the adjacent ink channel 63 and space 64, respectively. All the channel electrodes 67*a* are grounded. The space electrodes 67*b* on both sides of each ink channel 63 are connected together. The space electrodes 67*b* in each space 64 are insulated from each other.

When the head driver 5 (FIG. 1) applies voltage to the space electrodes 67*b* on both sides of any of the ink channels 63, the associated side walls 66 deform piezo-electrically in such directions that the channel or channels 63 enlarge in volume. For example, if a voltage of E volts is applied to the space electrodes 67*b* on both sides of one of the ink channels 63, as shown in FIG. 7, electric fields are generated in opposite directions E in the side walls 66 on both sides of the ink channel 63. The electric fields deform these side walls 66 piezo-electrically in such directions that the ink channel 63 enlarges in volume, reducing the pressure in this channel 63. This condition is maintained for the one-way propagation time T of a pressure wave in each ink channel 63. This supplies ink from the manifold (not shown) to the ink channel 63 during the propagation time T.

The one-way propagation time T is the time that it takes for a pressure wave in each ink channel 63 to be propagated longitudinally of the channel 63. This propagation time T is L/a (T=L/a) where L is the length of the ink channel 63 and a is the sound velocity in the ink in the channel 63.

An example of the ink ejector was tested. Each ink channel 63 of the ejector had a length L of 6.0 mm. Each nozzle 69 of the ejector had a length of 50 μm, a diameter of 25μm on its outer side for ejection of ink, and a diameter of 40 μm on its inner side adjacent to the associated channel 63. The ink used for the test had a viscosity of about 2 mPa·s and a surface tension of 30 mN/m at a temperature of 25° C. The ratio L/a (=T) of the length L to the sound velocity a in the ink in each ink channel 63 was 9 μsec.

According to the theory of pressure wave propagation, exactly when the time T passes after the voltage is applied to the pair of space electrodes 67*b*, the pressure in the associated ink channel 63 reverses into a positive pressure. Roughly when the pressure becomes positive, the voltage is returned to 0 volt. This allows the deformed side walls 66 to return to their original condition, applying a positive pressure to the ink in the ink channel 63. This pressure is added to the pressure which has reversed to be positive. As a result, a relatively high pressure develops in that portion of the ink channel 63 which is near to the associated nozzle 69, ejecting an ink droplet through the nozzle.

If the period after the voltage is applied and until it is returned to 0 volt differs from the one-way propagation time T, the energy efficiency for the droplet ejection lowers. If this period is roughly an even number of times the propagation time T, no ink is ejected. Therefore, in general, in order to raise the energy efficiency, for example, to drive the side walls 66 at a voltage as low as possible, it is preferable that the period be roughly equal to the propagation time T or at least roughly an odd number of times the time T.

Figure 2A:
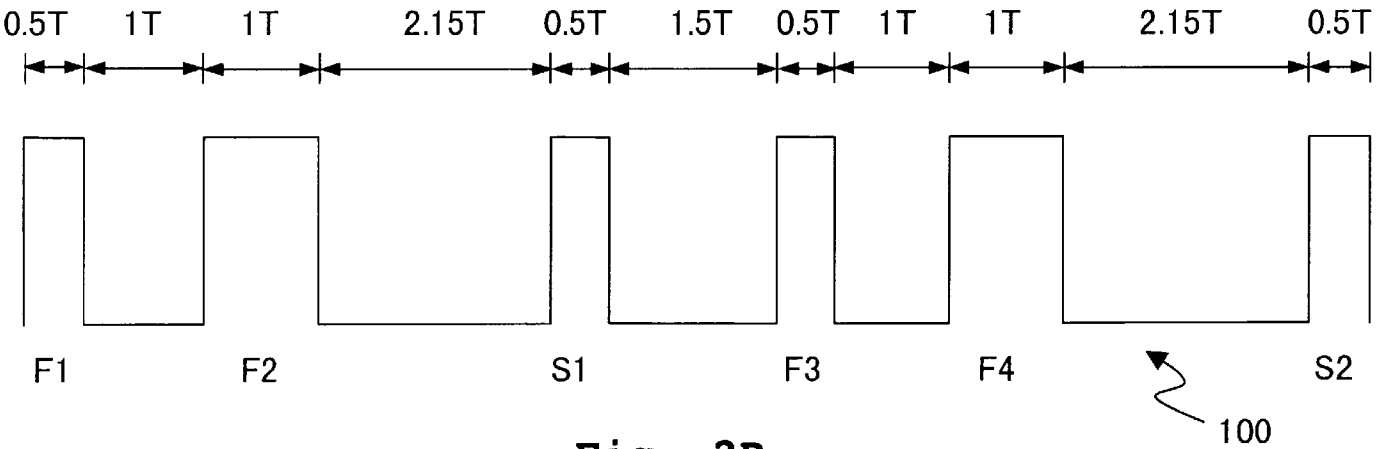
FIG. 2A is a chart showing a drive pulse waveform for a lower resolution for an ink ejector according to the embodiment.
Figure 2B:
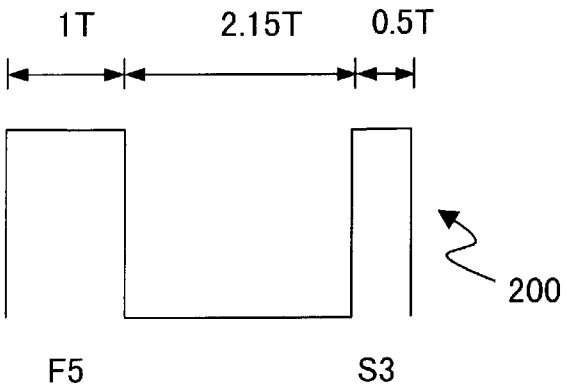
FIG. 2B is a chart showing a drive pulse waveform for a higher resolution for the ink ejector according to the embodiment.

FIGS. 2A and 2B show drive waveforms 100 and 200 for the record head 6. FIG. 2A shows the drive waveform 100 for low resolution (for example, 300×300 dpi). FIG. 2B shows the drive waveform 200 for high resolution (for example, 600×600 dpi). The use of such waveforms makes it easy to control the volume of the ink droplets ejected from the ink channels 63.

With reference to FIG. 2A, the drive waveform 100 for low resolution includes ejection pulses F1, F2, F3 and F4 and ejection stabilization pulses S1 and S2 for printing one dot. The ejection pulses F1–F4 are applied to eject four ink droplets at different times from one of the ink channels 63. The stabilization pulses S1 and S2 are applied to reduce the residual pressure wave vibration in the ink channel 63 without ejecting ink. All the pulses F1–F4, S1 and S2 have a crest value (voltage) of E volts (for example, 16 volts at 25° C.).

The width of the ejection pulse F1 is 0.5T (T is the one-way propagation time of a pressure wave in each ink channel 63). This pulse width for the foregoing sample ink ejector (T=L/a=9 μsec) was 4.5 μsec. The interval between the ejection pulses F1 and F2 equals T. This pulse interval for the ejector was 9 μsec. The width of the ejection pulse F2 equals T. This pulse width for the ejector was 9 μsec. The interval between the ejection pulse F2 and the stabilization pulse S1 is 2.15T. This pulse interval for the ejector was 19.35 μsec. The width of the stabilization pulse S1 is 0.5T. This pulse width for the ejector was 4.5 μsec. The interval between the stabilization pulse S1 and the ejection pulse F3 is 1.5T. This pulse interval for the ejector was 13.5 μsec. The width of the ejection pulse F3 is 0.5T. This pulse width for the ejector was 4.5 μsec. The interval between the ejection pulses F3 and F4 equals T. This pulse interval for the ejector was 9 μsec. The width of the ejection pulse F4 equals T. This pulse width for the ejector was 9 μsec. The interval between the ejection pulse F4 and the stabilization pulse S2 is 2.15T. This pulse interval for the ejector was 19.35 μsec. The width of the stabilization pulse S2 is 0.5T. This pulse width for the ejector was 4.5 μsec.

These pulse intervals (timing) and widths make it possible to control the volume and stability of the ink droplets. The waveform 100 for low resolution is applied to eject four ink droplets at different times from one of the ink channels 63 in accordance with a record instruction for one dot by ejecting a series of two ink droplets with the ejection pulses F1 and F2, restraining the residual pressure wave vibration in the ink channel 63 with the stabilization pulse S1, ejecting another series of two ink droplets with the ejection pulses F3 and F4, and restraining the vibration of ink near the associated nozzle 69 with the stabilization pulse S2. The four ejection pulses F1–F4 achieve the droplet volume of 60 pl necessary for one dot. The pulse intervals and widths were found out experimentally for stable ejection of ink without splashes at frequencies between 5 and 8.5 kHz from a low temperature of 5° C. to a high temperature of 45° C.

With reference to FIG. 2B, the drive waveform 200 for high resolution includes an ejection pulse F5 and an ejection stabilization pulse S3 for printing one dot. The ejection pulse F5 is applied to eject an ink droplet from one of the ink channels 63. The stabilization pulse S3 is applied to reduce the residual pressure wave vibration in the ink channel 63 without ejecting ink. The pulses F5 and S3 have a crest value of E volts (for example, 16 volts at 25° C.).

The width of the ejection pulse F5 equals the one-way propagation time T of a pressure wave in each ink channel 63. This pulse width for the foregoing sample ink ejector was 9 μsec. The interval between the ejection pulse F5 and the stabilization pulse S3 is 2.15T. This pulse interval for the ejector was 19.35 μsec. The width of the stabilization pulse S3 is 0.5T. This pulse width for the ejector was 4.5 μsec.

These pulse interval and widths make it possible to control the volume and stability of the ink droplet. The waveform 200 for high resolution achieves the droplet volume of 15 pl necessary for one dot by ejecting one ink droplet from one of the ink channels 63 with the ejection pulse F5 and reducing the residual pressure wave vibration in the ink channel 63 with the stabilization pulse S3 in accordance with a record instruction for one dot. The pulse interval and widths were found out experimentally for stable ejection of ink without splashes at a frequency of 15.0 kHz from a low temperature to a high temperature.

The foregoing ink ejector was tested with the drive waveforms 100 and 200 (FIGS. 2A and 2B) to find out drive voltage curves so that record density or concentration is constant at any temperature.

The ink ejector was driven with the drive waveform 100 for low resolution at a drive voltage of 16 volts and an ambient temperature of 25° C. for recording at 300×300 dpi. Four ink droplets were ejected per dot at a speed of 8.0 m/s with the ejection pulses F1–F4. The volume of the four droplets amounted to 60 pl. In this case, the change in drive voltage is controlled so that the drive voltage dropped by 2%

Figure 3:
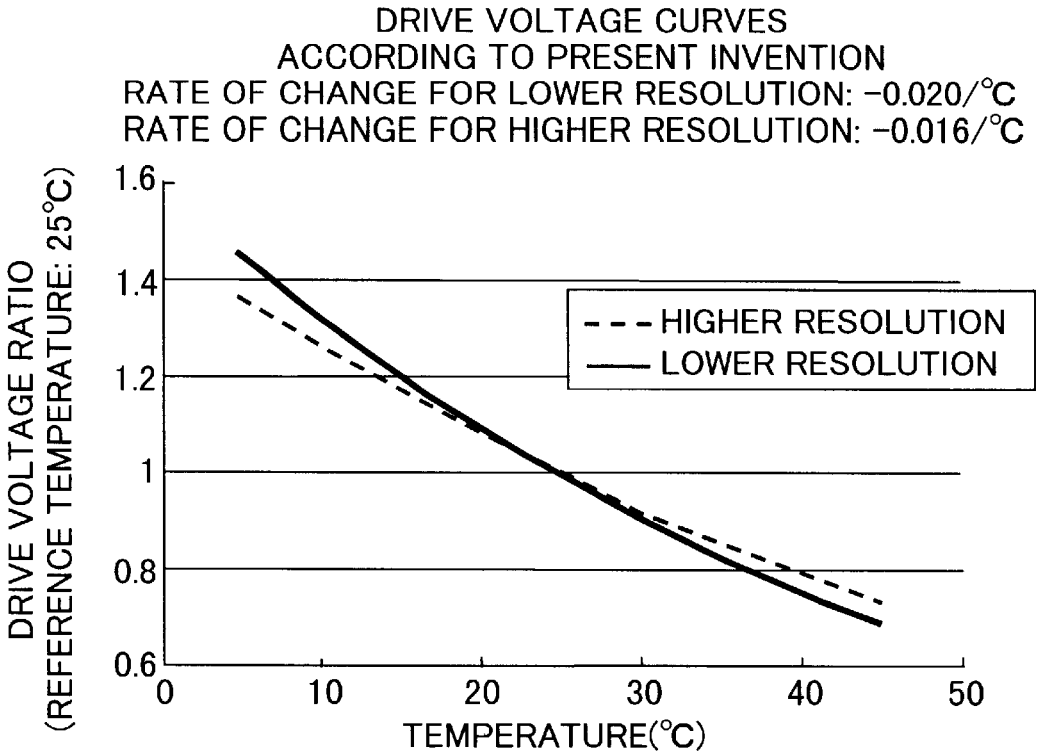
FIG. 3 is a chart showing changes in drive voltage with temperature for different record resolutions in the embodiment.
Figure 4:
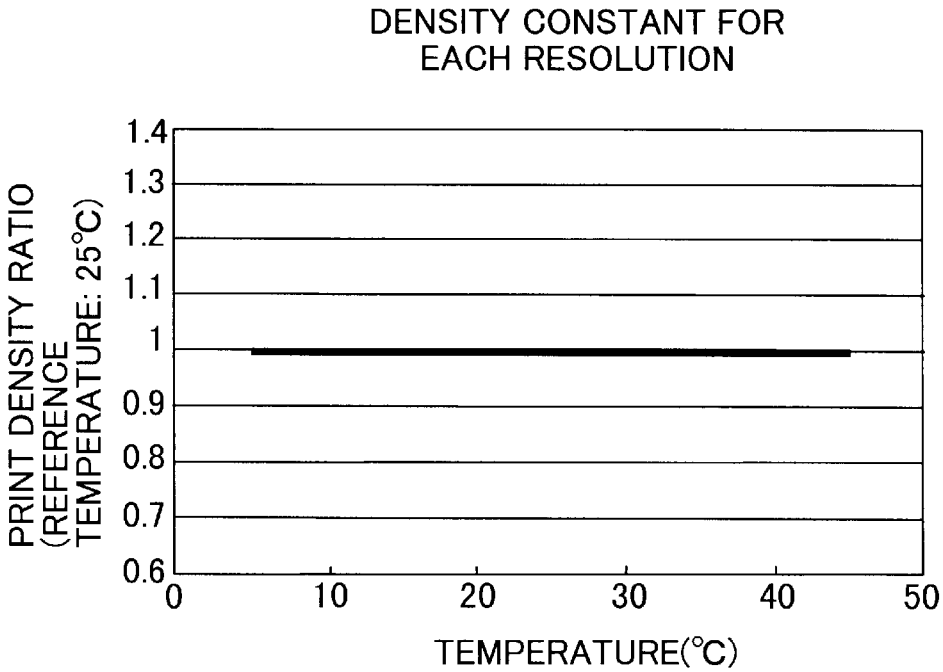
FIG. 4 is a chart showing a change in record density with temperature in a case where drive voltage curves according to the embodiment are used.
Figure 5:
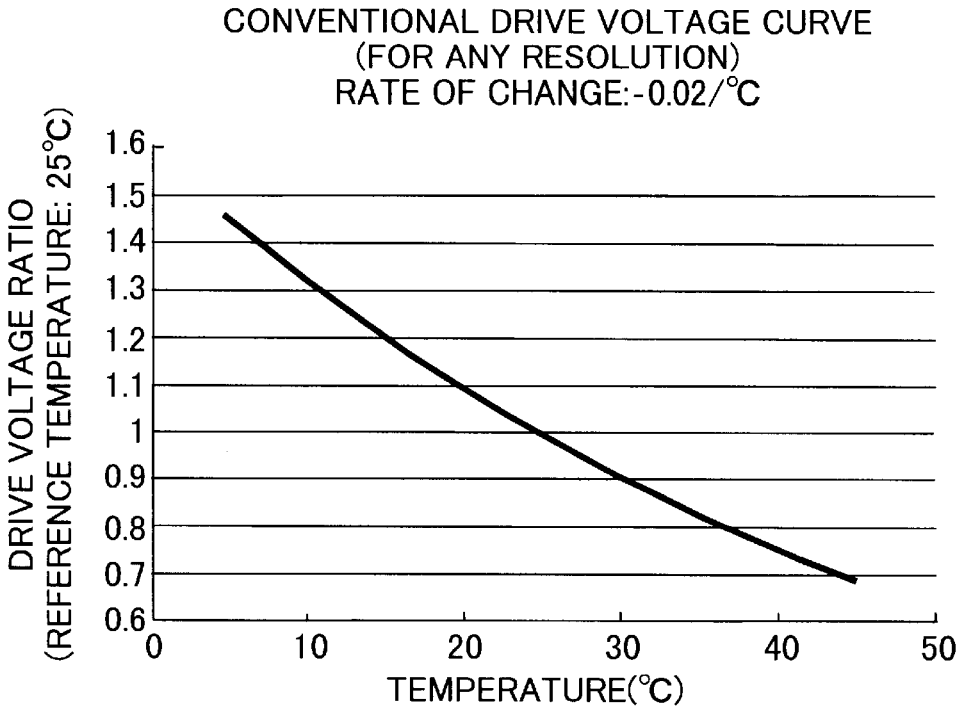
FIG. 5 is a chart showing a change in drive voltage with temperature in prior art.
Figure 6:
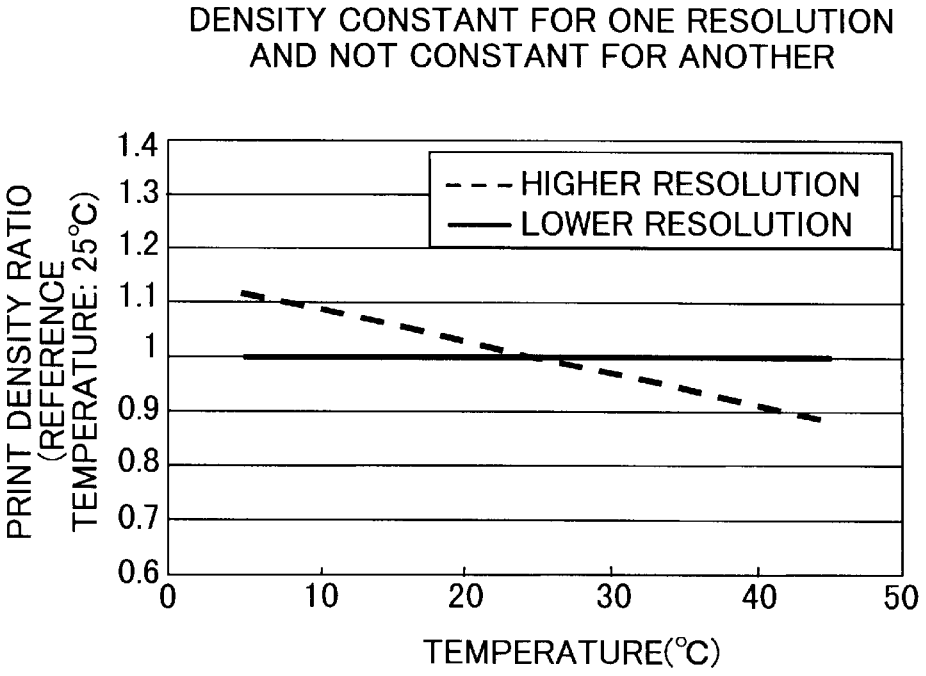
FIG. 6 is a chart showing changes in record density with temperature in a case where a conventional drive voltage curve is used.

(−0.02 times) when the ambient temperature rose by 1° C., as shown in FIG. 3. It was found that this control made the record density constant at temperatures from 5° C. to 45° C., as shown in FIG. 4.

The ink ejector was also driven with the drive waveform 200 for high resolution at a drive voltage of 17 volts and the ambient temperature of 25° C. for recording at 600×600 dpi. One ink droplet was ejected per dot at a speed of 7.5 m/s with the ejection pulse F5. The volume of the ink droplet was 15 pl. In this case, the change in drive voltage is controlled such that the drive voltage dropped by 1.6% (−0.016 times) when the ambient temperature rose by 1° C., as shown in FIG. 3. It was found that the control made the record density constant at the temperatures from 5° C. to 45° C., as shown in FIG. 4.

It is thus found that the record density can be constant at any temperature if the absolute value of the rate of change in drive voltage with respect to temperature is reduced as the resolution rises and the ejected ink droplet or droplets become smaller in volume.

Some recording tests have revealed that the record density can be roughly constant at any temperature if, in the case of the record resolution is four times (×4) or higher per unit area with respect to a standard record resolution, the absolute value of the rate of change in drive voltage with ambient temperature is about 0.8 or less.

As stated above, the ink jet recorder detects the temperature related to the ink. For lower record resolution, the recorder causes the ink jet head to eject a larger volume of ink per dot. For higher record resolution, the recorder causes the ink jet head to eject a smaller volume of ink per dot. For lower record resolution, the absolute value of the rate of change in drive voltage with ambient temperature is made larger. For higher record resolution, the absolute value of the rate of change in drive voltage with respect to ambient temperature is made smaller. Specifically, if the record resolution is four times (×4) or higher per unit area, the absolute value of the rate of change in drive voltage with respect to ambient temperature is made about 0.8 or smaller. This enables the record density to be constant at any temperature.

What is claimed is:

1. An ink jet recording method for recording on a record medium with a recorder including an actuator, the actuator which has an ink channel filled with ink and a nozzle communicating with the channel, the recorder applying a drive voltage to the actuator so that the channel changes in volume to eject ink therefrom through the nozzle, the method comprising the steps of:

detecting a temperature of the ink or an ambient temperature around the ink;

controlling the drive voltage depending on the detected temperature and record resolution; and driving the actuator at the controlled voltage to eject ink from the ink channel through the nozzle.

2. The recording method according to claim 1, wherein the drive voltage is lowered as the detected temperature rises.

3. The recording method according to claim 2, wherein a rate of change in the drive voltage with respect to temperature is controlled to be smaller for higher record resolution.

4. The recording method according to claim 3, wherein the rate of change in drive voltage with respect to temperature is determined so that record density is substantially constant within a predetermined temperature range.

5. The recording method according to claim 4, wherein the temperature range ranges between 5° C. and 45° C.

6. The recording method according to claim 1, and comprising the step of selecting a pulse waveform for application to the actuator depending on the record resolution.

7. The recording method according to claim 6, wherein the amplitude of the pulse waveform is lowered as the detected temperature rises.

8. The recording method according to claim 6, wherein fewer ink droplets are ejected to form a dot on the record medium at higher record resolution.

9. An ink jet recorder comprising:

an actuator having an ink channel to be filled with ink and a nozzle communicating with the channel, the channel changing volume thereof to eject ink therefrom through the nozzle when a drive voltage is applied to the actuator;

a switch for selecting a record resolution;

a temperature detector for detecting the temperature of the ink or the ambient temperature around the ink; and a controller for controlling the drive voltage depending on the selected resolution and the detected temperature.

10. The recorder according to claim 9, wherein the controller lowers the drive voltage as the detected temperature rises.

11. The recorder according to claim 9, wherein the controller reduces a rate of change in the drive voltage with respect to the ink temperature or the ambient temperature as the selected resolution rises.

12. The recorder according to claim 11, wherein the controller makes an absolute value of the rate of change 0.8 or less if the selected resolution is four times (×4) or higher per unit area with respect to a standard resolution.

13. The recorder according to claim 11, wherein the controller determines an absolute value of the rate of change so that record density is substantially constant within a predetermined temperature range.

14. The recorder according to claim 13, wherein the temperature range ranges between 5° C. and 45° C.

15. The recorder according to claim 11, further comprising a driver for driving the actuator, wherein the controller sends a control signal to the driver.

16. The recorder according to claim 11, wherein the record resolution is selected from at least 300×300 dpi and 600×600 dpi.

17. The recorder according to claim 9, wherein the controller selects a pulse waveform for application to the actuator depending on the selected resolution.

18. The recorder according to claim 17, wherein the controller lowers the amplitude of the pulse waveform as the detected temperature rises.

19. The recorder according to claim 18, wherein fewer ink droplets are ejected to form a dot on a record medium at higher record resolution.

* * * * *